US005201667A

United States Patent [19]

Endo et al.

[11] Patent Number: 5,201,667

[45] Date of Patent: Apr. 13, 1993

[54] BRANCH CIRCUIT STRUCTURE

[75] Inventors: Takayoshi Endo; Sakai Yagi; Masanori Tsuji; Kimihiro Abe, all of Shizuoka, Japan

[73] Assignee: Yazaki Corporation, Tokyo, Japan

[21] Appl. No.: 720,127

[22] Filed: Jun. 24, 1991

[30] Foreign Application Priority Data

Jun. 27, 1990 [JP] Japan ..... 2-67256[U]
Jun. 27, 1990 [JP] Japan ..... 2-67257[U]
Aug. 1, 1990 [JP] Japan ..... 2-81162[U]

[51] Int. Cl.[5] ..... H01R 29/00

[52] U.S. Cl. ..... 439/189; 439/278; 439/511; 439/587; 439/509

[58] Field of Search ..... 439/49, 189, 278, 283, 439/507, 509, 511, 512, 587, 595

[56] References Cited

U.S. PATENT DOCUMENTS 4,591,221 5/1986 DeBrouckere et al. ..... 439/509
4,621,883 11/1986 Noguchi ..... 439/278
4,735,581 4/1988 Endo et al. ..... 439/278
4,895,533 1/1990 Yagi et al. ..... 439/278
4,952,155 8/1990 Kuzuno et al. ..... 439/189
4,997,390 3/1991 Scholz et al. ..... 439/511
5,000,699 3/1991 Nadin ..... 439/511

FOREIGN PATENT DOCUMENTS 61-277180 12/1986 Japan .

*Primary Examiner*—Paula A. Bradley
*Attorney, Agent, or Firm*—Sughrue, Mion, Zinn, Macpeak & Seas

[57] ABSTRACT

A branch circuit structure comprises, a housing including a plurality of juxtaposed terminal chambers, a plurality of metal terminals each having a wire connection portion and electrical contact portion, and inserted into the terminal chambers from one end of the terminal chambers, and a short-circuit member disposed into the other end of the terminal chambers, and having a plurality of contact portions to be connected to the metal terminals, respectively.

23 Claims, 9 Drawing Sheets

BRANCH CIRCUIT STRUCTURE

BACKGROUND OF THE INVENTION

The invention relates to a branch circuit structure for use in forming branch circuits mainly in the wire harness of motor vehicles.

In FIG. 1, inside a female connector housing a are secured joint terminals b, b' secured, each joint terminal connecting a plurality of tab-like contacts $b_1$ thereto. Inside a male connector housing c is a terminal receiving slot $c_1$ disposed so as to confront each tab-like contact $b_1$ with a female terminal piece d attached thereto, the metal piece d being connected to an electric wire w in advance. Under this construction, a branch circuit is formed from one electric wire to another when the male and female connector housings a, c are coupled to each other through the joint terminal b and the female terminal piece d.

In the aforesaid conventional art, it is difficult to confirm in wire harness fabrication lines that the joint terminals and the female terminal pieces are completely connected.

Further, with the aforesaid conventional art, the coercive force of the terminals within the female and male connector housings cannot be maintained.

Furthermore, to make the wire harness waterproof under the aforesaid conventional art, the male connector housing must be provided with both waterproof packing and waterproof plugs. Since the plurality of joint terminals b, b' are arranged inside a common chamber of the female connector housing a, there is a likelihood that any unused empty circuit will provide the source of leakage.

SUMMARY OF THE INVENTION

The invention has been made under the above circumstances. Accordingly, an object of the invention is to provide a branch circuit unit which has a structure allowing insertion of a terminal piece to be detected easily and which is applicable to a waterproof type.

Another object of the invention is to provide a branch circuit unit which is capable of maintaining the coercive force of terminal pieces inside the housings with a simple structure and which is applicable to a waterproof type.

Still another object of the invention is to provide a branch circuit unit which can easily be waterproofed and which can eliminate the use of empty plugs to unused circuits for the prevention of leakages.

To achieve the above objects, a first aspect of the invention is applied to a branch circuit structure which includes: a housing having a plurality of terminal receiving slots juxtaposed; a plurality of terminal pieces, each of which is held while inserted into each terminal receiving slot from one side thereof; and a short-circuiting piece having a plurality of contacts which are to be connected to the terminal pieces while inserted into the terminal receiving slots, respectively, from the other side thereof. In such a branch circuit structure, each terminal receiving slot has a cantilevered flexible support strip which projects from a wall surface of the terminal receiving slot and forms a detection gap together with the wall surface when the cantilevered flexible support strip is abutted against the terminal piece that has been completely inserted into the terminal receiving slot, and the short-circuiting piece has bars for detecting insertion of the terminal pieces that are advancing into the detection gaps.

A second aspect of the invention is applied to a branch circuit structure which includes: a housing having an opening on one side thereof and having a plurality of terminal receiving slots juxtaposed; short-circuiting piece juxtaposing a plurality of tab-like male contacts and a plurality of resilient stopping bars in two rows, upper and lower, so as to confront the plurality of terminal receiving slots, each resilient stopping bar having an engaging portion; and a female terminal piece having a female type electric contact and an electric wire connecting portion. In such a branch circuit structure, the short-circuiting piece positions the tab-like male contacts and the resilient stopping bars within the terminal receiving slots, respectively, by having itself secured to the closed wall portion of the terminal receiving slot with its base by insert-molding, and a stopping portion formed at the female type electric contact is engaged with the resilient stopping bar when the female terminal piece and the tab-like male contact have been coupled to each other.

A third aspect of the invention is applied to a branch circuit structure which includes: a housing having an opening on one side thereof and having a plurality of terminal receiving slots juxtaposed; a short-circuiting piece having a plurality of contacts juxtaposed in correspondence with the plurality of terminal receiving slots; a terminal piece having an electric contact and an electric wire connecting portion; and a waterproof plug having holes for inserting electric wires that are connected to the electric wire connecting portions. In such a branch circuit structure, the short-circuiting piece positions the contacts within the terminal receiving slots, respectively, by having itself secured to the closed wall portion of the terminal receiving slot with its base by insert-molding; the contact of the short-circuiting piece and the electric contact of the terminal piece are coupled to each other within the terminal receiving slot; and the opening is sealed by the waterproof plug.

DETAILED DESCRIPTION OF THE PREFERRED EMBODIMENTS

Figure 1:
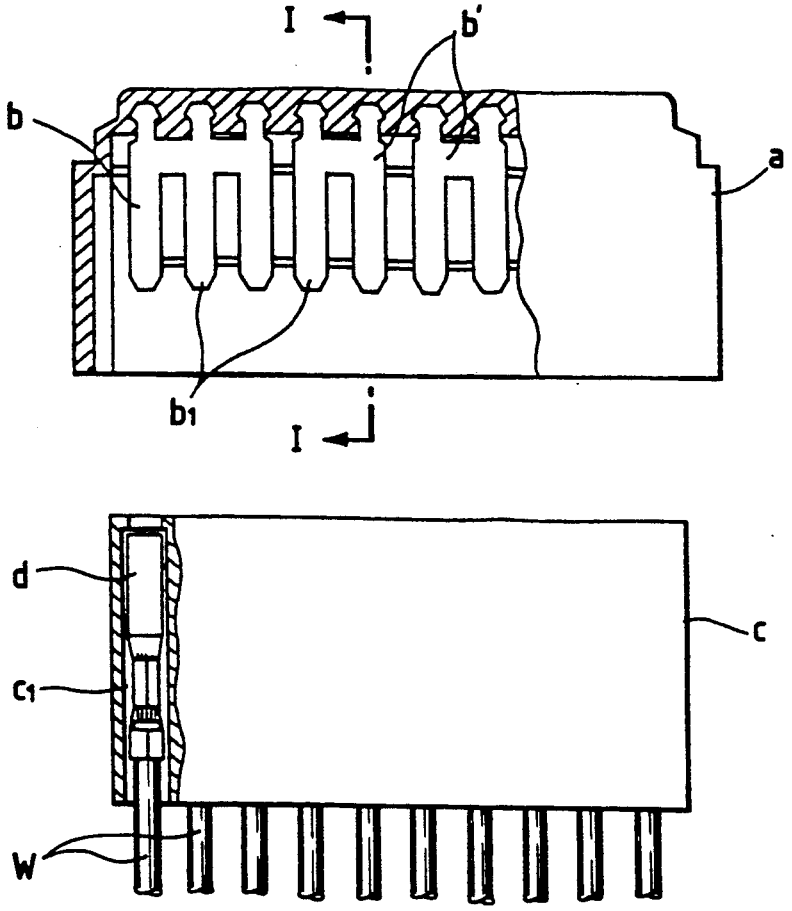
FIG. 1 PRIOR ART
FIG. 1 is a partial sectional plan view of a conventional branch circuit structure.
Figure 2:
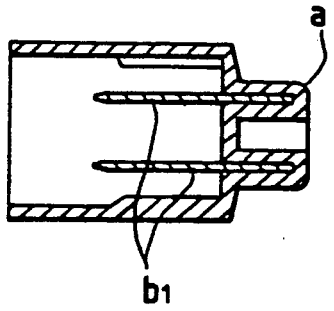
FIG. 2 PRIOR ART
FIG. 2 is a sectional view taken along a line I—I shown in FIG. 1.
Figure 3:
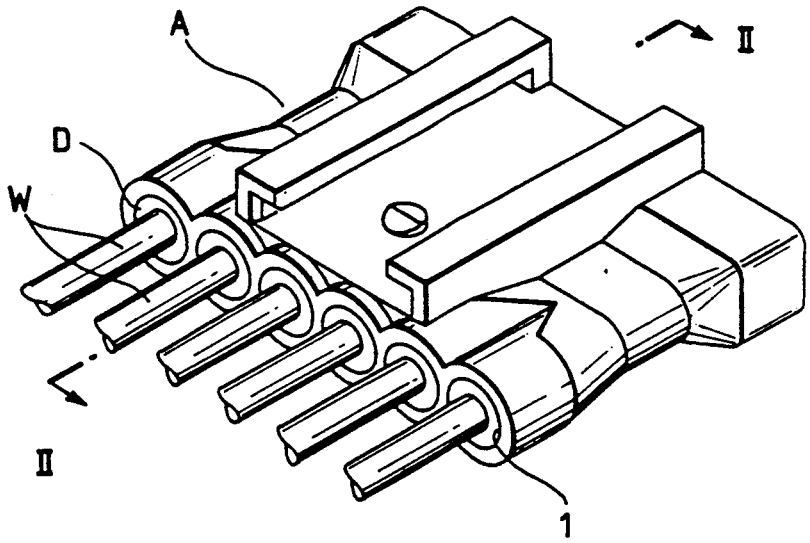
FIG. 3 is a perspective view of an embodiment of the invention.
Figure 4:
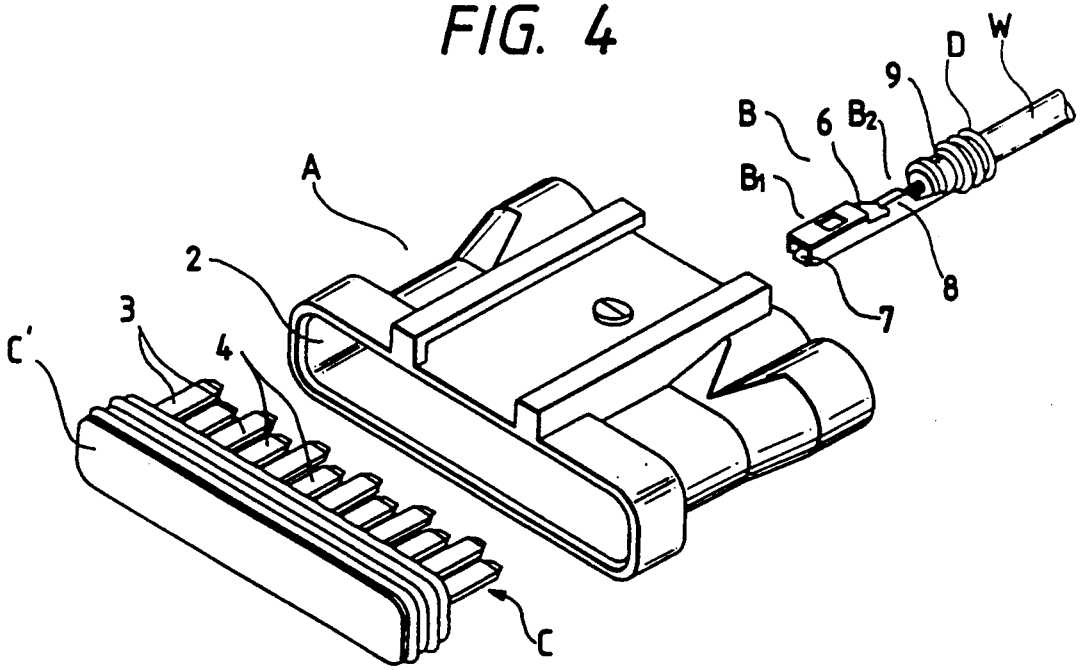
FIG. 4 is an exploded perspective view of the embodiment shown in FIG. 3.
Figure 5:
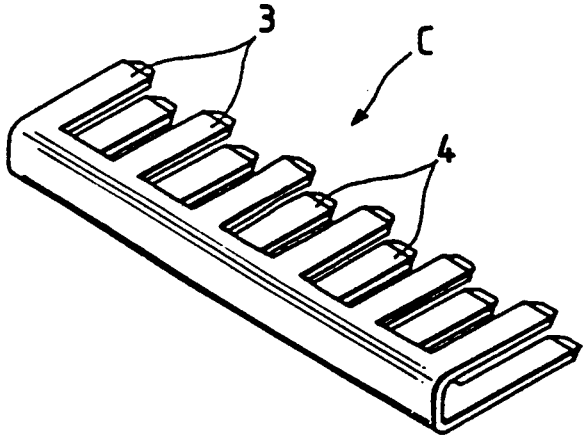
FIG. 5 is a perspective view of a short-circuiting piece.
Figure 6:
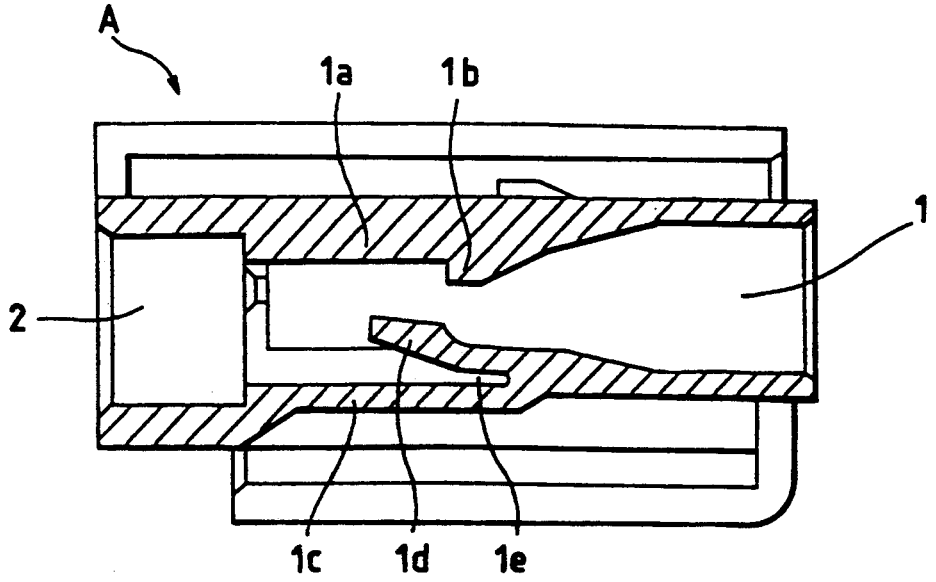
FIG. 6 is a sectional view of a housing.
Figure 7:
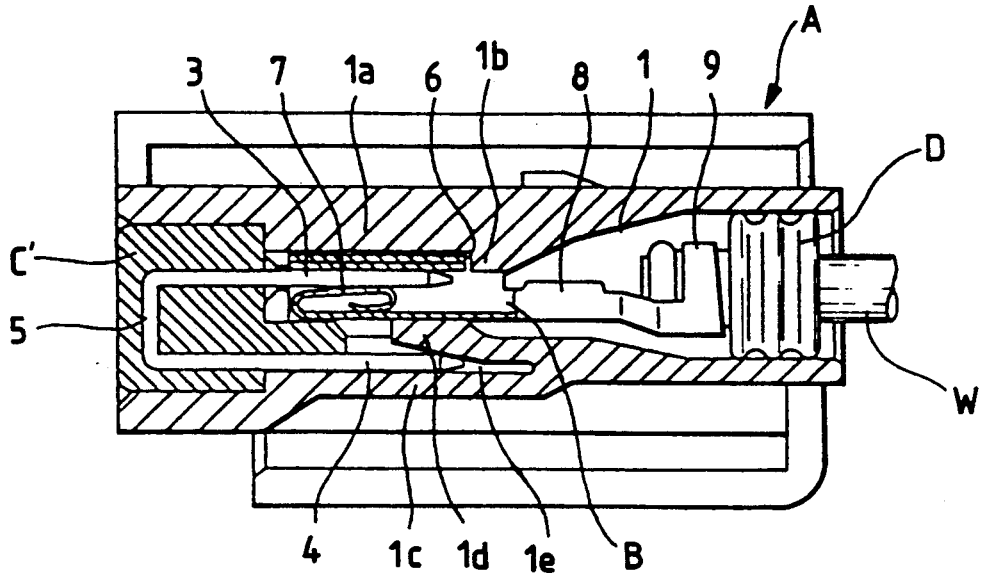
FIG. 7 is a sectional view taken along a line II—II shown in FIG. 3.

The present invention will now be described in more detail with reference to be the accompanyings drawings.

In FIGS. 3 to 7, reference character A designates a housing made of a synthetic resin; B, a female terminal piece; and C, a short-circuiting piece.

In the housing A are a plurality of terminal receiving slots 1 juxtaposed, while on one end of the terminal receiving slots 1 is a receptacle 2 for receiving a rubber plug body C' of the short-circuiting piece C formed so as to communicate with the terminal receiving slots 1.

In each terminal receiving slot 1, a stepped portion 1*b* that is to be engaged with the female terminal piece B is formed at a rear position of an upper wall 1*a*, while a cantilevered flexible support strip 1*d* is disposed so as to be biased upward on a lower wall 1*c* confronting the upper wall 1*a*. A detection gap le is interposed between the flexible support strip 1*d* and the lower wall 1*c*. The gap le is a gap into which each detection bar of a terminal piece (described later) is entered (see FIG. 5).

On the upper row of the short-circuiting piece C are tab-like male contacts 3 arranged so as to be close to one another in correspondence with the respective terminal receiving slots 1, while on the lower row thereof are the bars 4 for detecting the insertion of the terminal pieces arranged so as to be close to one another in pairs with the respective tab-like male contacts 3. The base 5 of the short-circuit piece C is provided with the rubber plug body C'. If the short-circuiting piece C is not required to be waterproofed, the plug body may be formed of a synthetic resin member or may be dispensed with.

The female terminal piece B includes a female electric contact $B_1$ and an electric wire connecting portion $B_2$. The female electric contact $B_1$ has an engaging shoulder 6 at its rear and a resilient contact strip 7 in its interior. As is well known, the electric wire connecting portion $B_2$ is provided with a conductor compression strip 8 and an insulating sheath compression strip 9 of an electric wire w, and a rubber plug body D that is fitted around the electric wire w is secured to the wire by the insulating sheath compression strip 9.

In the above construction, each female terminal piece B is inserted into each terminal receiving slot 1 of the housing A from the rear of the housing. At the time of insertion, the female piece B advances while pressing downward the flexible support strip 1*d* which is positioned along its way, and when the female type electric contact $B_1$ has surpassed the engaging stepped portion 1*b*, the flexible support strip 1*d* pushes the terminal piece B upward to cause the engaging shoulder portion 6 to be engaged with the engaging stepped portion 1*b*. As a result, the detection gap 1*e* is opened frontward between the flexible support strip 1*d* and the lower wall 1*c*.

Under this state, while inserting the rubber plug body C' into the receptacle 2 from the front of the housing A, the tab-like male contacts 3 of the short-circuiting piece C are inserted into the female type electric contacts $B_1$, respectively, thereby to connect the terminal pieces B to one another. The insertion detecting bars 4 advance into the detection gaps 1*e*.

If there is any terminal piece B whose insertion is incomplete, it is impossible for the corresponding insertion detecting bar 4 to advance into the detection gap 1*e*. As a result, the entire part of the short-circuiting piece C cannot be attached, thereby allowing an incomplete insertion of the terminal piece B to be detected.

Figure 8:
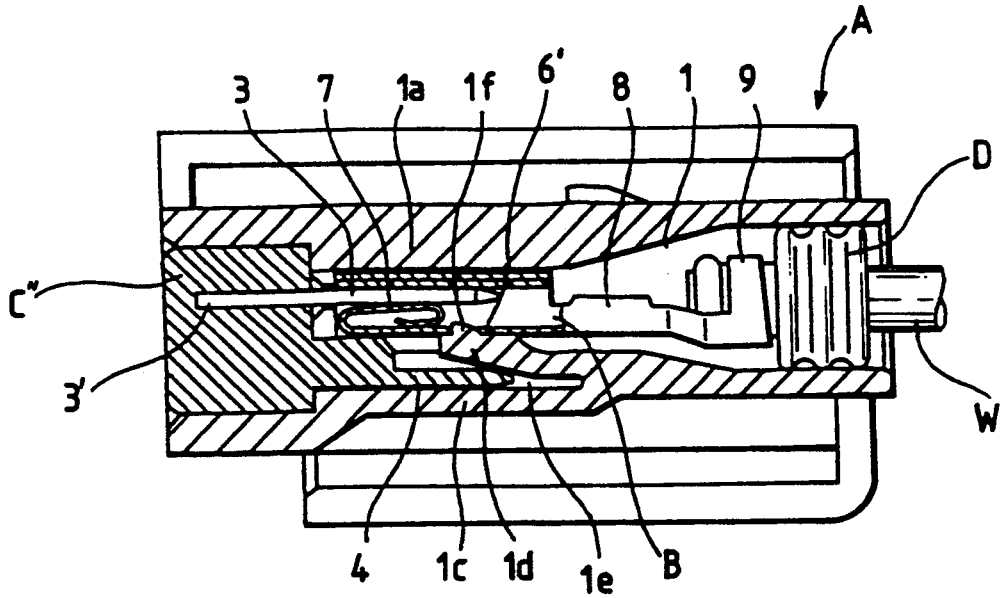
FIG. 8 is a sectional view of another embodiment of the invention.
Figure 9:
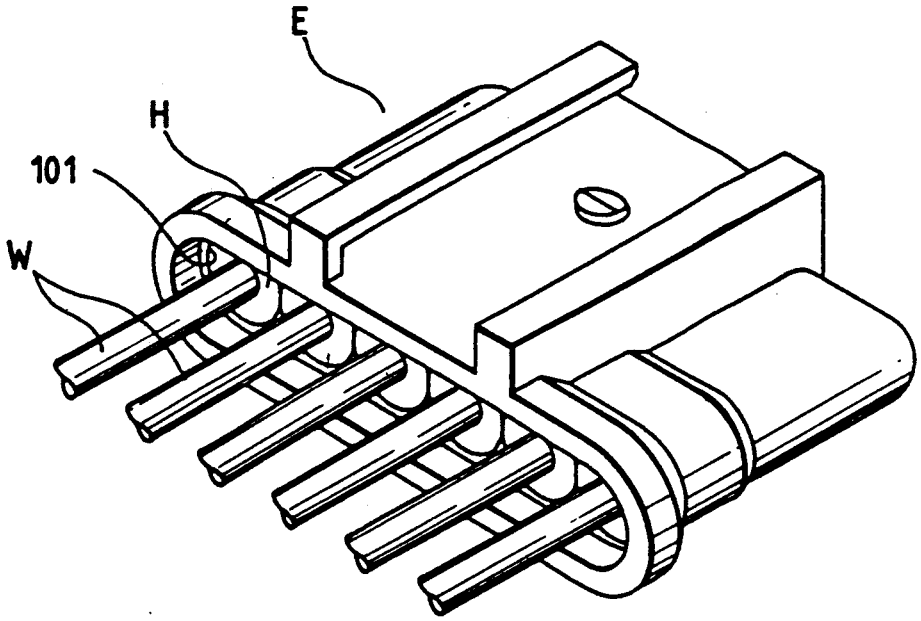
FIG. 9 is a perspective view showing still another embodiment of the invention.
Figure 10:
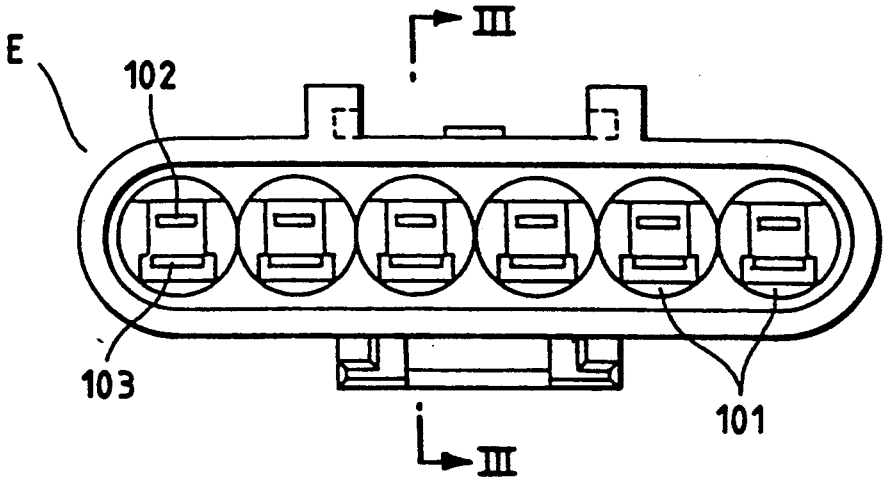
FIG. 10 is a front view of a connector.
Figure 11:
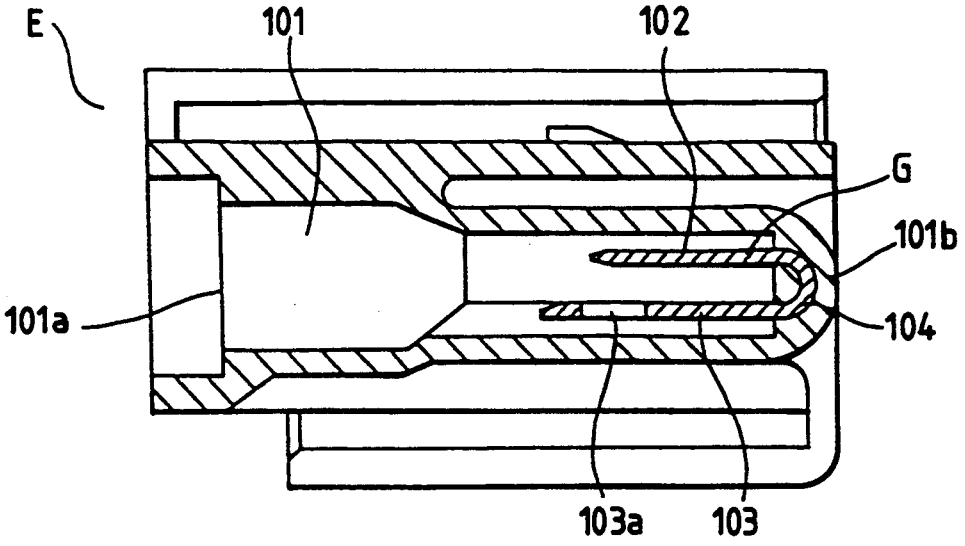
FIG. 11 is a sectional view taken along a line III—III shown in FIG. 9.
Figure 12:
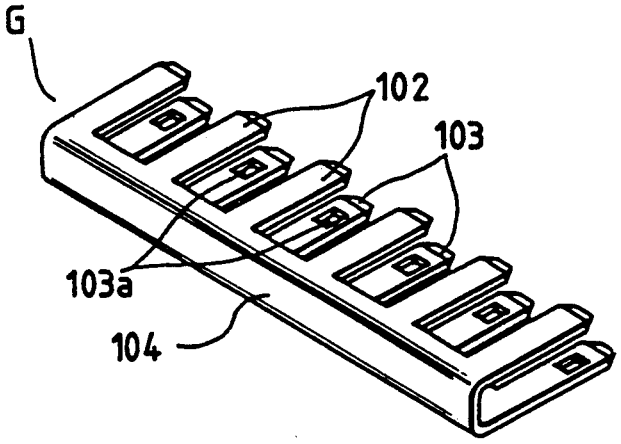
FIG. 12 is a perspective view of a short-circuiting piece.

In an embodiment shown in FIG. 8, a stopping projection 1*f* formed on the flexible support strip 1*d* is engaged with a stopping hole 6' of each female terminal piece B so that the female terminal piece B will not be pulled out backward, and the base 3' of each tab-like male contact 3 of the short-circuiting piece is supported by the synthetic resin-made plug body C'' while embedded thereinto, and the synthetic resin-made plug body C'' is provided with insertion detecting bars 4', which are arranged close to one another so as to correspond to the respective tab-like male contacts 3.

While the short-circuiting piece C is of male type and each terminal piece B is of female type in the above embodiments, the types of the pieces C and B may be reversed.

As described above, these embodiments include: a housing having a plurality of terminal receiving slots juxtaposed; a plurality of terminal pieces, each of which is held while inserted into each terminal receiving slot from one side thereof; and a short-circuiting piece having a plurality of contacts, each of which is to be connected to each terminal piece while inserted into each terminal receiving slot from the other side thereof. In such embodiments, each terminal receiving slot has a cantilevered flexible support strip which projects from a wall surface of the terminal receiving slot and forms a detection gap together with the wall surface when the cantilevered flexible support strip is abutted against the terminal piece that has been completely inserted into the terminal receiving slot, and the short-circuiting piece has bars for detecting insertion of the terminal pieces that are advancing into the detection gaps. Therefore, branch circuits which are applicable to a wire harness or the like can be constructed with ease and their complete connection can be verified. In addition, they are suitable for waterproof applications.

Another embodiment will be described next.

In FIGS. 9 to 14, reference character E designates a housing made of a synthetic resin; F, a female terminal piece; and G, a short-circuiting piece.

The housing E has a plurality of terminal receiving slots 101 juxtaposed, each of the terminal receiving slot having an opening 101*a* on one side thereof, while a closed wall 101*b* on the other side has the short-circuiting piece G secured thereto by insert-molding.

The short-circuiting piece G has on its upper row tab-like male contacts 102 arranged close to one another so as to be in correspondence with the respective terminal receiving slots 101, and has on its lower row resilient stopping bars 103, each of the bars 103 having a stopping hole 103*a* which serves as a portion to be engaged with the female terminal piece F in pairs with the tab-like male contact 102. The short-circuiting piece G is secured to the closed wall 101*b* with its base 104 while formed integrally with the wall 101*b* by insert-molding.

Figure 13:
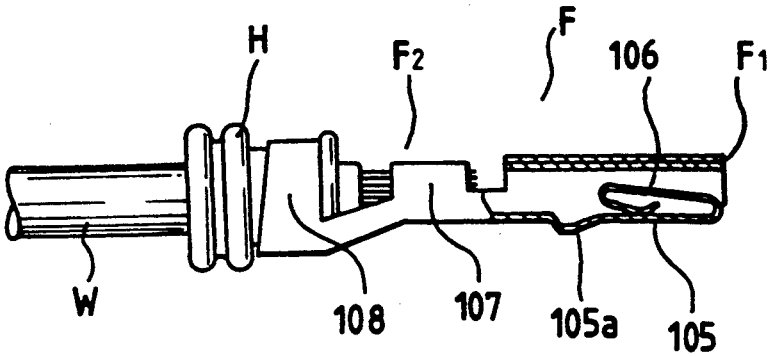
FIG. 13 is a partially cutaway side view of a female terminal piece.
Figure 14:
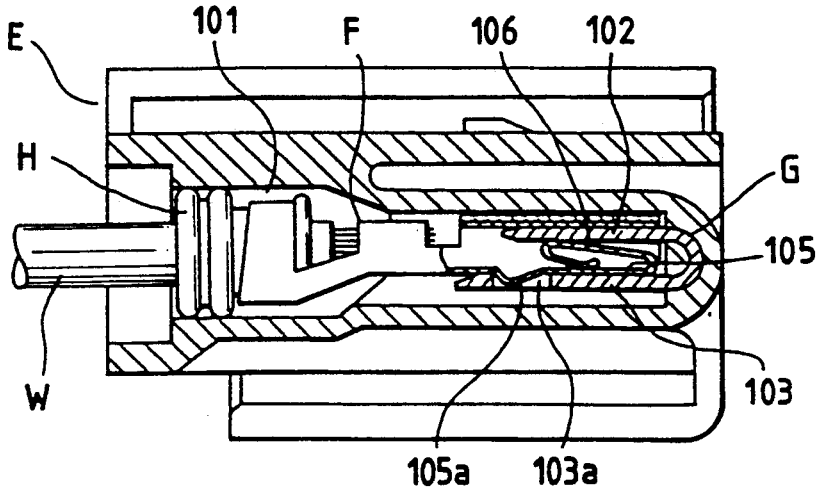
FIG. 14 is a sectional view showing a state of all pieces being assembled.

As shown in FIG. 13, each female terminal piece F has a female type electric contact $F_1$ and an electric wire connecting portion $F_2$, and the female type electric contact $F_1$ has not only a resilient contact strip 106 formed by folding back an extending portion of a bottom plate 105, but also a stopping projection 105*a* serving as a stopping portion which is bent outwardly in the bottom plate 105. As known well, each electric wire connecting portion $F_2$ is provided with a conductor compression strip 107 and an insulating sheath compression strip 108 of an electric wire w, and a rubber plug body H is fitted around the electric wire w by the insulating sheath compression strip 108.

In the above construction, each female terminal piece F which is connected with the electric wire w in advance is inserted into each terminal receiving slot 101 of the housing E, and each female type electric contact $F_1$ is brought into contact with each tab-like male contact 102 of the short-circuiting piece G, so that the branch circuits are formed between a plurality of electric wires w through the short-circuiting piece G. At this instance, the stopping projection 105*a* formed at the bottom plate 105 of the female type electric contact F gets engaged with the stopping hole 103*a* of the resilient stopping bar 103 while displacing the resilient stopping bar 103, and as a result, not only contact between the stopper projection 105*a* and the short-circuiting piece G is ensured, but also the rubber plug body H closes the opening 101*a* of the terminal receiving slot 101 for waterproof. The stopping projection 105*a* may be arranged on the resilient stopping bar 103 and the stopping hole 103*a* on the female terminal piece F.

As described above, this embodiment includes: a housing having an opening on one side thereof and having a plurality of terminal receiving slots juxtaposed; a short-circuiting piece juxtaposing a plurality of tab-like male contacts and a plurality of resilient stopping bars in two rows, upper and lower, so as to confront the plurality of terminal receiving slots, each resilient stopping bar having an engaging portion; and a female terminal piece having a female type electric contact and an electric wire connecting portion. In this embodiment, the short-circuiting piece positions the tab-like male contacts and the resilient stopping bars within the terminal receiving slots, respectively, by having itself secured to the closed wall portion of the terminal receiving slot with its base by insert-molding, and a stopping portion formed at the female type electric contact is engaged with the resilient stopping bar when the female terminal piece and the tab-like male contact have been coupled to each other. Therefore, branch circuits which are applicable to a wire harness or the like can be constructed with ease and their complete connection can be verified. In addition, they are suitable for waterproof applications.

Still another embodiment of the invention will be described.

Figure 15:
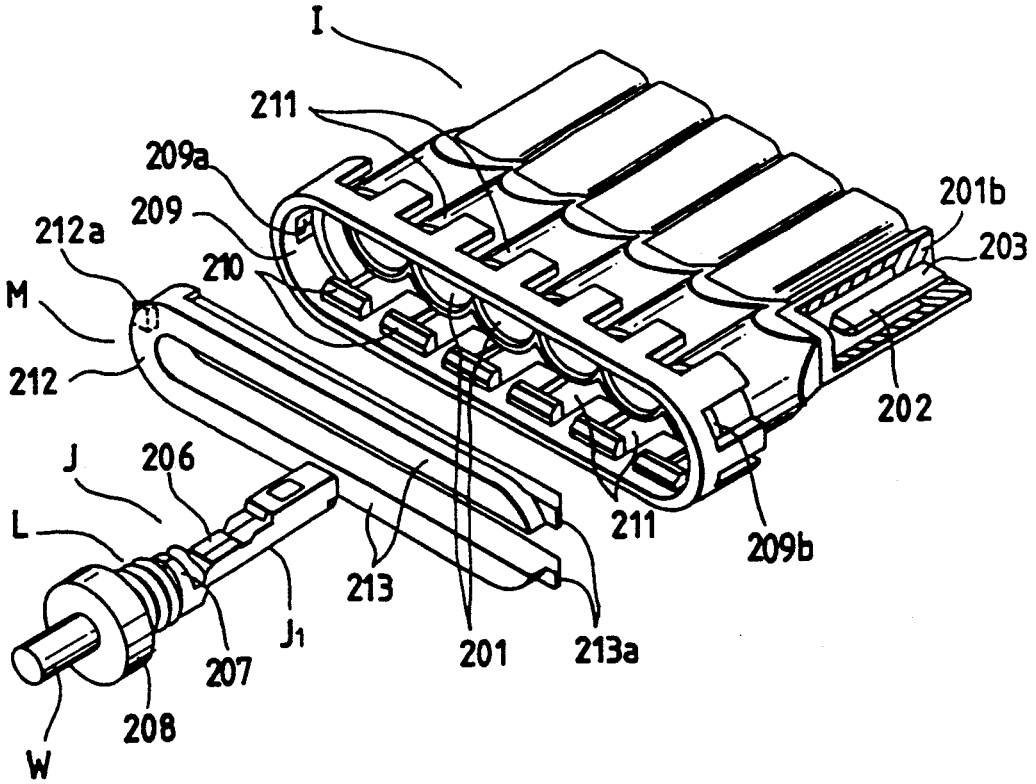
FIG. 15 is an exploded perspective view of still another embodiment of the invention.
Figure 16:
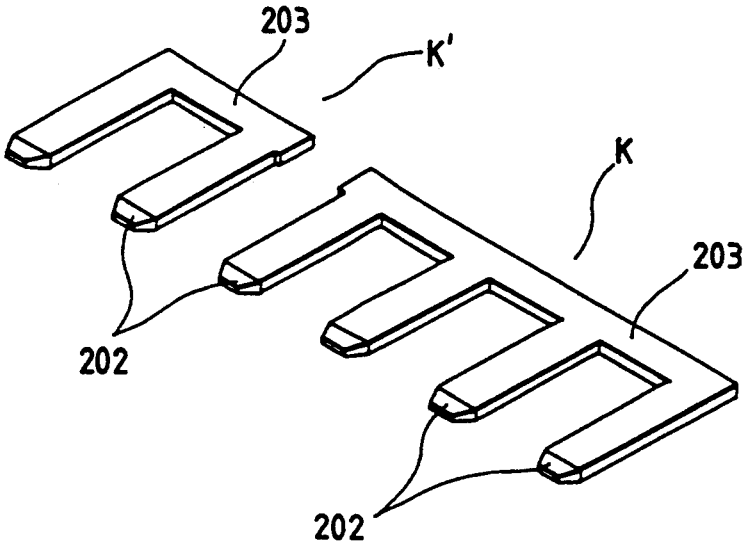
FIG. 16 is a perspective view of a short-circuiting piece used in the embodiment shown in FIG. 15.
Figure 17:
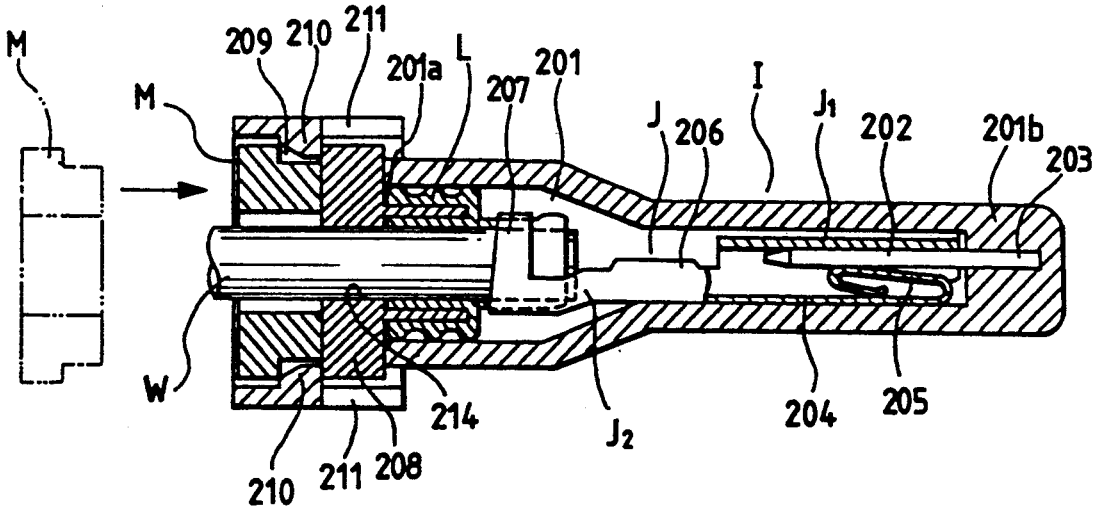
FIG. 17 is a longitudinal sectional view of the embodiment shown in FIG. 15 as assembled.

In FIGS. 15 to 17, reference character I designates a housing made of a synthetic resin; J, a female terminal piece; and K, K', short-circuiting pieces.

The housing I has a plurality of terminal receiving slots 201 juxtaposed, each terminal receiving slot having an opening 201 on one side thereof, while a closed wall 201*b* on the other side of the housing I has short-circuiting pieces K, K' secured thereto by insert-molding.

The short-circuiting pieces K, K' have a plurality of tab-like male contacts 202 arranged close to one another in correspondence with the respective terminal receiving slots 201, and are secured to the closed wall 201*b* with its base 203 while formed integrally with the wall 201*b* by insert-molding. and have are secured to the closed wall 201*b* and formed integrally through a base 203 by insert-molding.

Each female terminal piece J has a female type electric contact $J_1$ and an electric wire connecting portion $J_2$, and has a resilient contact strip 205 formed by folding back an extending portion of a bottom plate 204 in the female type electric contact portion $J_1$. As known well, each electric wire connecting portion $J_2$ is provided with a conductor compression strip 206 and an insulating sheath compression strip 207 of an electric wire w, and a rubber-made waterproof plug body L is fitted around the electric wire w and secured by the insulating sheath compression strip 207 through an electric wire insertion hole 214. The rubber-made waterproof plug body L has a synthetic resin-made pressure receiving body 208 assembled thereinto by integral forming.

In the rear of each terminal receiving slot 201 extends a common space 209, and the upper and lower wall surfaces of the common space have stopping projections 210 and notches 211 formed in correspondence with the respective terminal receiving slots 201.

In the above construction, each female terminal pieces J which is connected to the electric wire w and the waterproof plug L in advance is inserted into each terminal receiving slot 201 of the housing I, and the female type electric contact $J_1$ is brought into contact with each tab-like male contact 202 of the short-circuiting pieces K, K', so that the branch circuits are formed between a plurality of electric wires w through the short-circuiting pieces K, K'. At this instance, the waterproof plug body L is fitted with the opening 201*a* of each terminal receiving slot 201 to provide waterproof, and the synthetic resin-made pressure receiving body 208 engages the stopping projection 210 while displacing the stopping projection and surpassing it (as shown in FIG. 17).

Reference character M designates a bifurcated rear holder made of a synthetic resin, which not only causes a stopping projection 212*a* of a base 212 to be engaged with a notched engaging portion 209*a* while inserted into the common space 209, but also causes stopping projections 213*a* at free ends of a bifurcated strip 213 to be engaged with the other notched engaging portions 209*b* so that the synthetic resin-made pressure receiving body 208 is supported.

Figure 18:
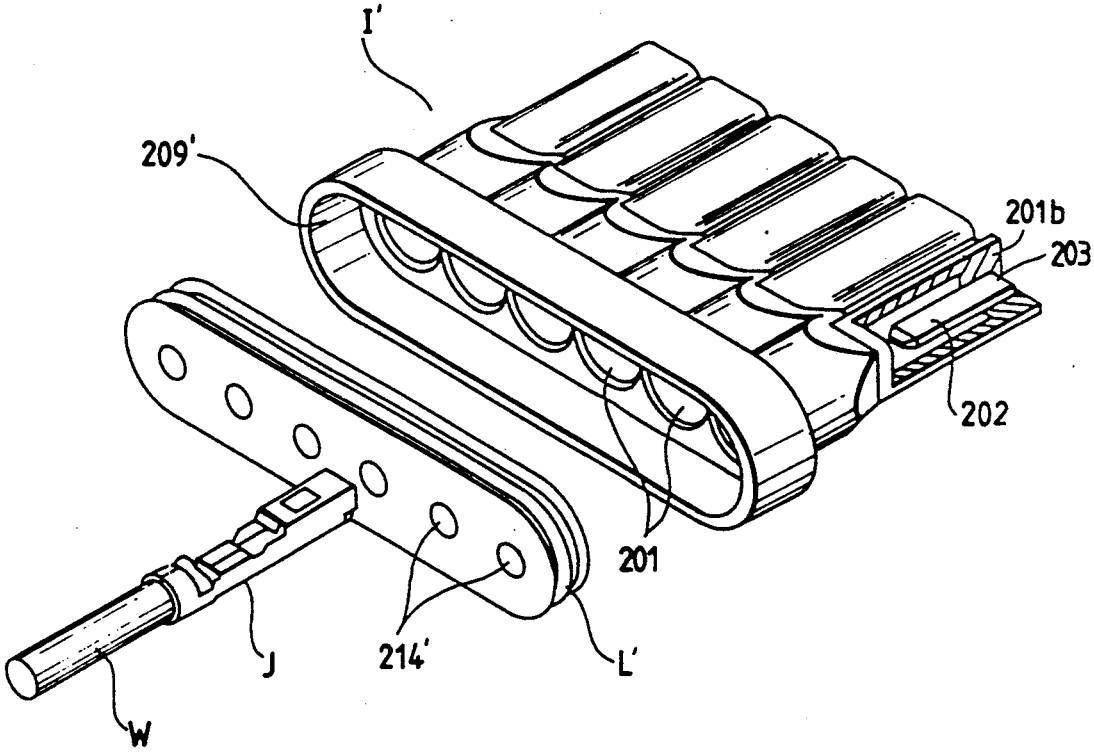
FIG. 18 is an exploded perspective view of still another embodiment of the invention.
Figure 19:
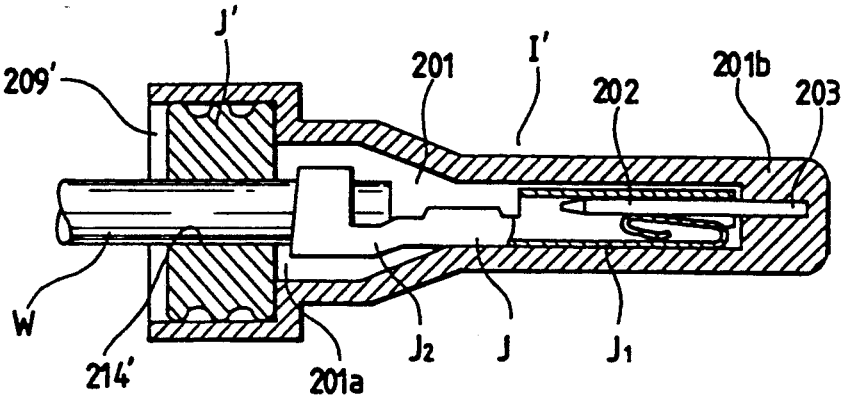
FIG. 19 is a longitudinal sectional view of the embodiment shown in FIG. 17 as assembled.

In an embodiment shown in FIGS. 18 and 19, the terminal pieces J has no waterproof plug body L or pressure receiving body 208, which therefore dispenses with the stopping projection 210, the notch 211, and the like in its housing I'. Instead, a common waterproof plug body L' that is fitted with the common space 209 is used, forming an electric wire insertion hold 214' that corresponds to each terminal receiving slot 201.

As described above, these embodiments include: a housing having an opening on one side thereof and having a plurality of terminal receiving slots juxtaposed; a short-circuiting piece having a plurality of contacts juxtaposed in correspondence with the plurality of terminal receiving slots; a terminal piece having an electric contact and an electric wire connecting portion; and a waterproof plug having holes for inserting electric wires connected to the electric wire connecting portions. In such embodiments, the short-circuiting piece positions each contact within each terminal receiving slot by having itself secured to the closed wall portion of the terminal receiving slot with its base by insert-molding; the contact of the short-circuiting piece and the electric contact of the terminal piece are coupled to each other within the terminal receiving slot; and the opening is sealed by the waterproof plug. Therefore, it is easy to waterproof the branch circuits, and there is no need for providing a waterproof plug in any unused terminal receiving slot to prevent leakage even if there are some unused circuits in the short-circuiting piece, since the respective terminal receiving slots are independent of one another.

What is claimed is:

1. A branch circuit structure, comprising:

a housing including a plurality of independent juxtaposed terminal chambers, said chambers being isolated from one another;

a plurality of metal terminals each having a wire connection portion and an electrical contact portion, and being insertable into said terminal chambers from one end of said terminal chambers;

a short-circuit member disposed in the other end of said terminal chambers, and having a plurality of contact portions to be connected to said metal terminals respectively;

a plurality of rubber plugs fixed to the wire connecting portion of each of said terminals to be fitted within each of said terminal chambers, respectively, such that each of said terminals is waterproofed, each of said plugs including a pressure receiving body for retaining said plugs within said chambers; and a rear holder adapted to be engaged with said housing at said one end, said rear holder abutting against each of said pressure receiving bodies to retain said bodies in place.

2. A branch circuit structure, comprising:

a housing including a plurality of juxtaposed terminal chambers;

a plurality of metal terminals each having a wire connection portion and an electrical contact portion, and being insertable into said terminal chambers from one end of said terminal chambers; and a short-circuit member insertable into the other end of said terminal chambers, and having a plurality of contact portions to be connected to said metal terminals, respectively; and terminal insertion detecting means for detecting whether or not said terminal insertion is complete, at least a portion of said detecting means being disposed on said short circuit member.

3. A branch circuit structure as claimed in claim 2, wherein said short circuit member is inserted into the other end of said terminal chambers.

4. A branch circuit structure as claimed in claim 2, wherein a rubber plug is firmly attached to an electric wire connecting portion of each of said terminal pieces to be fitted with said terminal chamber.

5. A branch circuit structure of claim 2, wherein when terminal insertion is not complete, said short-circuit member cannot be inserted into said other end.

6. A branch circuit structure as claimed in claim 2, wherein said short-circuit member includes a plug to be fitted with a receptacle of said housing.

7. A branch circuit structure as claimed in claim 6, wherein said plug is made of rubber.

8. A branch circuit structure as claimed in claim 2, wherein said detecting means includes:

a cantilevered flexible support strip, provided with each of said receiving chambers and projecting from a wall surface of said terminal chamber, for forming a detection gap together with said wall surface, when said cantilevered flexible support strip is abutted against said terminal chamber; and insertion detecting bar, provided with said short circuit member, for detecting insertion of said terminal pieces advancing into said detection gaps.

9. A branch circuit structure as claimed in claim 8, wherein said insertion detecting bars are made of a material different from that of said short circuit member.

10. A branch circuit structure as claimed in claim 9, wherein said short circuit member secured to the other end of said terminal receiving chambers with a base of said short circuit member by insert molding.

11. A branch circuit structure, comprising:

a housing including a plurality of juxtaposed terminal chambers;

a plurality of metal terminals each having a wire connection portion and an electrical contact portion, and being insertable into said terminal chambers from one end of said terminal chambers; and a short-circuit member disposed in the other end of said terminal chambers, and having a plurality of contact portions to be connected to said metal terminals, respectively; and a plurality of rubber plugs fixed to the wire connecting portion of each of said terminal pieces to be fitted with each of said terminal chamber, respectively, wherein said short circuit member has at two rows, upper and lower, a plurality of said contact portions and a plurality of resilient stopping bars, respectively.

12. A branch circuit structure as claimed in claim 11, further comprising:

engaging means for engaging said chamber and said terminal.

13. A branch circuit structure as claimed in claim 12, wherein said engaging means includes:

an engaging portion formed on each of said resilient stopping bars; and a stopping portion, formed on each of said electrical contact portion of said metal terminal, engaged with said engaging portion.

14. A branch circuit structure comprising:

a housing including a plurality of independent juxtaposed terminal chambers;

a plurality of metal terminals each having a wire connection portion and an electrical contact portion, and being insertable into said terminal chambers from one end of said terminal chambers;

a short-circuit member disposed in the other end of said terminal chambers, and having a plurality of contact portions to be connected to said metal terminals, respectively; and lock means for locking said short circuit member with said metal terminal, said locking means being formed on said short-circuit member.

15. A branch circuit as claimed in claim 14, further comprising:

a plurality of rubber plugs fixed to the wire connecting portion of each of said terminals.

16. A branch circuit as claimed in claim 14, wherein said short circuit member has two rows, upper and lower, a plurality of said contact portions and said lock means.

17. A branch circuit as claimed in claim 16, wherein said housing includes a cantilevered flexible support strip provided within each of said receiving chambers and projecting from said wall surface of each of said terminal chambers so as to be engageable with each of said metal terminals, wherein when said cantilevered flexible support strip engages said terminals, said lock means prevents the disengagement of said support strip.

18. A branch circuit structure, comprising:

a housing including a plurality of independent juxtaposed terminal chambers;

a plurality of metal terminals each including a wire connection portion and an electrical contact portion, and being insertable into said terminal chambers from one end of said terminals chambers;

a short-circuit member including a base portion secured to the other end of said receiving chambers, and a plurality of contact portions to be connected to said metal terminals, respectively; and lock means for locking said short circuit member with said metal terminal, said locking means being formed on said short-circuit member.

19. A branch circuit as claimed in claim 18, wherein each said terminal has a lock portion directly engageable with said lock means provided with said short-circuit member.

20. A branch circuit as claimed in claim 18, wherein said short circuit member has two rows, upper and lower, a plurality of said contact portions and said lock means.

21. A branch circuit as claimed in claim 18, further comprising:

a plurality of rubber plugs fixed to said wire connecting portion of each of said terminals.

22. A branch circuit structure, comprising:

a housing including a plurality of independent juxtaposed terminal chambers;

a plurality of metal terminals each including a wire connection portion and an electrical contact portion, and being insertable into said terminal chambers from one end of said terminal chambers;

a short-circuit member including a base portion, fixedly secured to the other end of said receiving chambers, and a plurality of contact portions to be connected to said metal terminals, respectively;

a plurality of rubber plugs respectively fixed to said wire connecting portion of each of said terminals such that each of said terminals is waterproofed; and a rear holder for locking said rubber plugs, and attendantly said terminals, in said housing, said rear holder being engageable with said housing at said one end.

23. A branch circuit structure, comprising:

a housing including a plurality of independent juxtaposed terminal chambers;

a plurality of meal terminals each including a wire connection portion and an electrical contact portion, and being insertable into said terminal chambers from one end of said terminal chambers;

a short-circuit member including a base portion fixedly secured to the other end of said receiving chambers, and a plurality of contact portions to be connected to said metal terminals, respectively; and a waterproofed rear holder for locking said metal terminals in said chambers, said rear holder being engageable with the housing at said one end.

* * * * *